United States Patent [19]

Bradam

[11] Patent Number: 4,795,282

[45] Date of Patent: Jan. 3, 1989

[54] PAPER GUIDE AND STOP FOR MULTI-FUNCTION PRINTER

[75] Inventor: William R. Bradam, Cambridge, Ohio

[73] Assignee: NCR Corporation, Dayton, Ohio

[21] Appl. No.: 106,307

[22] Filed: Oct. 8, 1987

[51] Int. Cl.[4] ..... B41J 11/50; B41J 13/28; B65H 9/04

[52] U.S. Cl. ..... 400/605; 400/632.1; 271/246

[58] Field of Search ..... 400/630, 631, 632, 632.1, 400/600.1, 600.2, 605, 642; 271/245, 246

[56] References Cited

U.S. PATENT DOCUMENTS

| | | | |
|---|---|---|---|
| 1,148,963 | 8/1915 | Gammeter | 271/246 |
| 1,544,370 | 6/1925 | Burke | 37/266 |
| 1,550,780 | 8/1925 | Cerasoli | 37/266 X |
| 4,408,917 | 10/1983 | Iwai et al. | 400/637.2 |

FOREIGN PATENT DOCUMENTS

| | | | |
|---|---|---|---|
| 159366 | 9/1984 | Japan | 400/605 |
| 12367 | 1/1986 | Japan | 400/605 |
| 573102 | 11/1945 | United Kingdom | 37/266 |

OTHER PUBLICATIONS

U.S. application Ser. No. 67,757, D. E. Weeks et al. to NCR Corporation, filed Jun. 29, 1987.

*Primary Examiner*—Clifford D. Crowder
*Attorney, Agent, or Firm*—Wilbert Hawk, Jr.; Albert L. Sessler, Jr.

[57] ABSTRACT

Paper guide mechanism is provided for a multi-function printer capable of printing on journal tapes, receipts and single or multi-sheet slips or forms. The printer has a movable slip stop for limiting movement of a slip which is inserted into the printer. The paper guide mechanism is attached to or integral with the slip stop, and is designed to restrain the path of movement of the slip and other record media to prevent interference by said record media with the movable printhead of the printer which moves in a reciprocating path which is perpendicular to the paths of movement of the record media.

12 Claims, 6 Drawing Sheets

FIG. 10
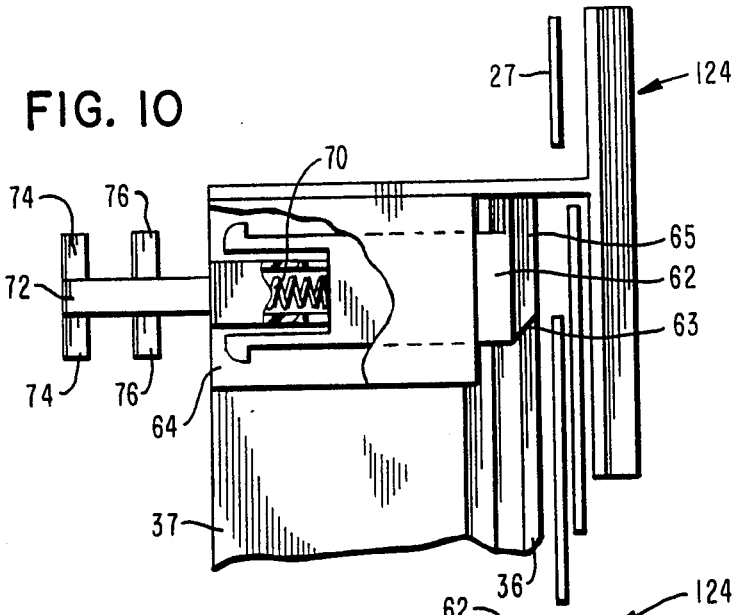
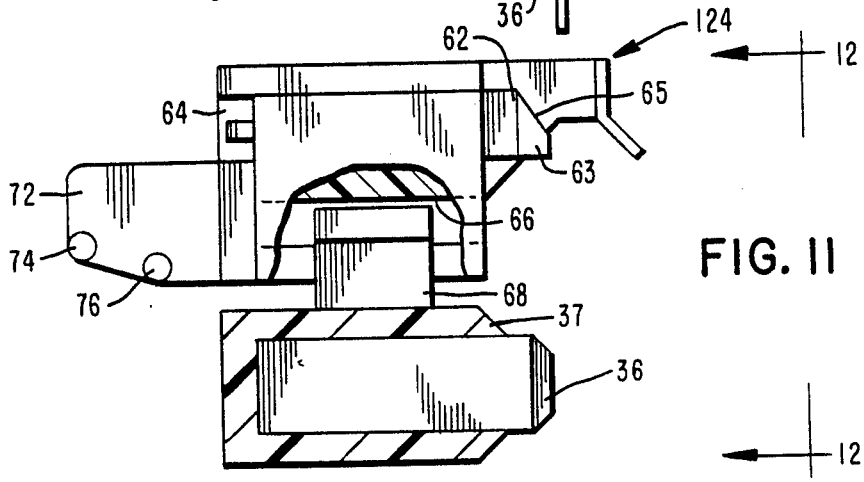
FIG. 11
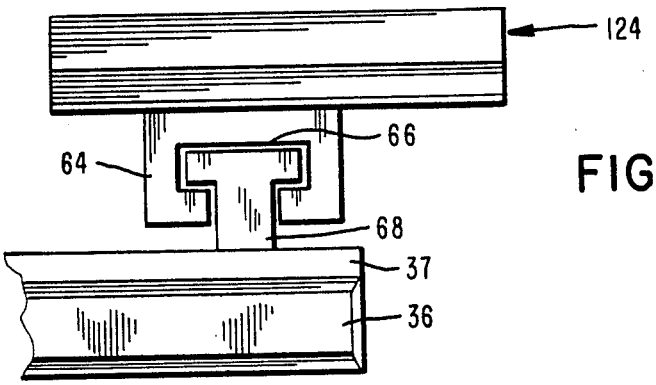
FIG. 12

PAPER GUIDE AND STOP FOR MULTI-FUNCTION PRINTER

BACKGROUND OF THE INVENTION

Multi-function printers have the capability of printing on several different types of record media in accordance with the requirements of a user's business. For example, in a retail business, a need may exist in connection with each transaction for making a record on a journal tape and also printing a customer receipt and a multi-part slip, such as may be used in connection with credit card transactions. Printing on these different types of record media in a multi-function printer is typically carried out by a dot matrix printhead which is mounted in the printer for reciprocating traversing movement across the different record media for serial printing of the requied data. During such traversing movement of the printhead, it is important that the various record media being printed upon are constrained in their positions so that they will not bow or otherwise extend outwardly into the path of the printhead, which would cause interference in printer operation and possible damage to the record media. Some mechanism is therefore desirable which is capable of maintaining the record media in the printer in a position in which said media will not interfere with movement of the printhead during printing.

SUMMARY OF THE INVENTION

The present invention relates to a paper guide mechanism and more particularly relates to a movable paper guide mechanism for use in a printer to prevent interference between the record media being printed upon and the movable printhead of the printer.

In accordance with a first embodiment of the invention, guide mechanism for guiding paper to be printed upon in a path which avoids interference with a printhead which moves in reciprocating motion in a direction perpendicular to the path of movement of said paper comprises a movable printhead; a platen arranged to cooperate with said printhead for printing on paper positioned between said platen and said printhead, said platen being movable between a retracted position which enables placement of paper between said printhead and said platen, and a forward position for a printing operation; a stop member movable between an extended position in which it is operable to limit movement of paper introduced for printing and a retracted position; means to move both the platen..and the stop member so that when said platen is in said forward position, said stop member is in said retracted position, and vice versa; and a paper guide member fixed to said stop member and extending outwardly therefrom and movable with said stop member, said guide member including a projecting portion extending outwardly from the stop member; a support member at the end of said projecting portion and perpendicular thereto, spaced from said stop member and parallel to the path of movement of said printhead; and a guide extending downwardly from said support member and adapted to extend over a paper when the stop member is in its extended position and to carry the paper backward as the stop member is moved toward its retracted position, thus eliminating possible interference by the paper with movement of the printhead.

In accordance with a second embodiment of the invention, a paper guide member for use in a printer comprises a planar portion adapted for attachment to a stop member of a printer, and being of generally rectangular configuration having a given length and depth; a connecting portion integral with one end of said planar portion and projecting outwardly therefrom, having an upper surface aligned with an upper surface of said planar portion and being of lesser depth than said planar portion; an elongated planar support member positioned at the end of said connecting portion, having an upper surface in the same plane as the upper surface of the connecting portion, and extending perpendicularly from said connecting portion in two opposite directions; and a planar guide member for guiding the movement of paper to be printed upon, attached to and extending downwardly from said support member all along its length, at an angle inclined away from said projecting portion.

It is accordingly an object of the present invention to provide a paper guide mechanism for use in a printer to prevent interference between record media being printed upon and a movable printhead.

Another object is to provide a paper guide mechanism which is movable in association with a stop member to guide record media being printed upon into a proper position with respect to a printhead.

With these and other objects, which will become apparent from the following description, in view, the invention includes certain novel features of construction and combinations of parts, a plurality of forms or embodiments of which are hereinafter described with reference to the drawings which accompany and form a part of this specification.

BRIEF DESCRIPTION OF THE DRAWINGS

FIG. 10 is a detail plan view, partially cut away, showing the slip stop and the pper guide mechanism, and record media associated therewith.

FIG. 11 is an elevation view of the structure of FIG. 10.

FIG. 12 is an end view of the structure of FIG. 10, taken along line 12—12 of FIG. 11.

DETAILED DESCRIPTION

Figure 1:
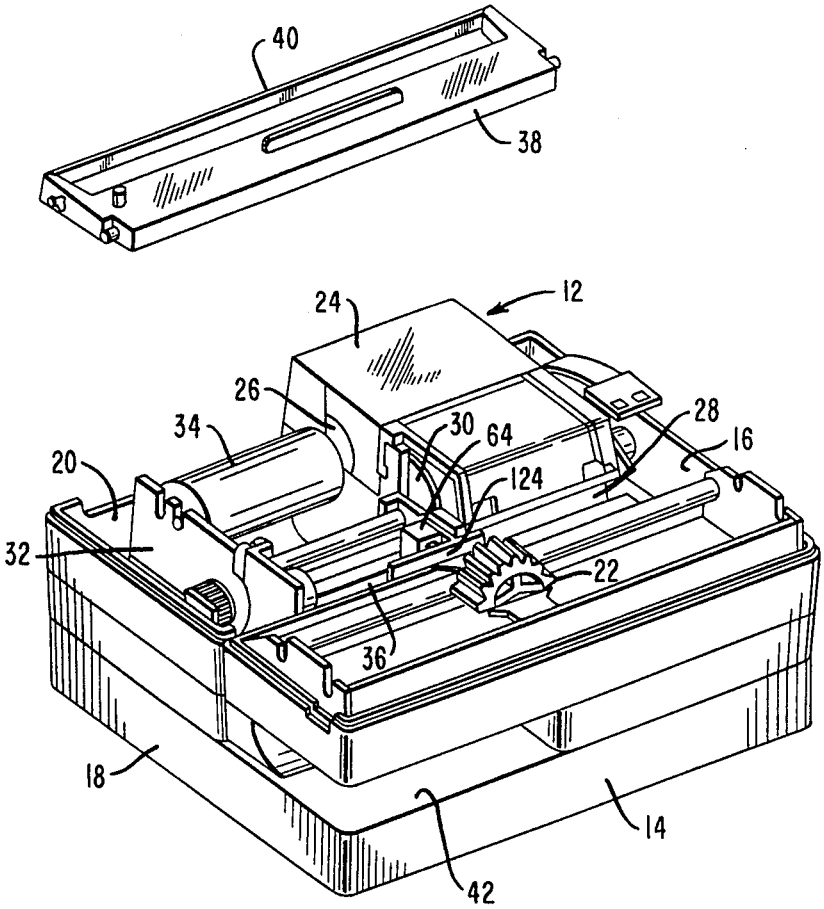
FIG. 1 is a perspective view of a printer embodying the present invention.

Referring now to the drawings, FIG. 1 shows a perspective view of a printer 12 having a front portion 14, a right side 16, a left side 18, and a rear portion 20. Such a printer, in which the paper guide mechanism of the present invention can be employed, may be of the multi-function type which can accommodate a receipt, a journal and a slip or form which may consist of one or more parts. Such a printer can be set in one of five different modes of operation which include printing a journal only, printing a receipt only, printing a receipt and a journal, printing a slip or form only, or printing a slip or form and a journal. In the illustrated printer, the journal and receipt can accommodate 42 columns of printing and the slip or form can accommodate 46 columns of printing. For a more detailed description of the structure and operation of such a printer, reference may be had to U.S. patent application, Ser. No. 067,757, filed June 29, 1987, now U.S. Pat. No. 4,780,007, inventors David E. Weeks et al., assigned to the assigne of the present application.

Returning to FIG. 1, a wire matrix printhead 22 is moved in a side-to-side manner by suitable drive means (not shown), located at the right front corner of the printer. A journal station or module 24 is provided at the right-hand side of the printer and includes a supply roll 26 of journal paper that is guided past the journal print station platen 28 and is rewound on a take-up roller 30 by a step-type drive motor (not shown). A paper guide member 124 controls the positioning of the record media, as will subsequently be described.

A receipt station or module 32 is provided at the left-hand side of the printer and includes a supply roll 34 of receipt paper that is guided past the receipt print station platen 36 and is driven by a step-type drive motor (not shown). The journal station and the receipt station are separated by six character spaces. A ribbon cassette 38 of the operator-changeable type is positioned to the rear of the printhead 22 and the ribbon 40 is driven in one direction from right to left in a path between the printhead and the record media (journal, receipt or slip). A slot 42 is provided at the left-front side for insertion of the slip which can be inserted from the front of the printer, from the side thereof or from the top in a path in front of the receipt paper at the receipt station.

Figure 2:
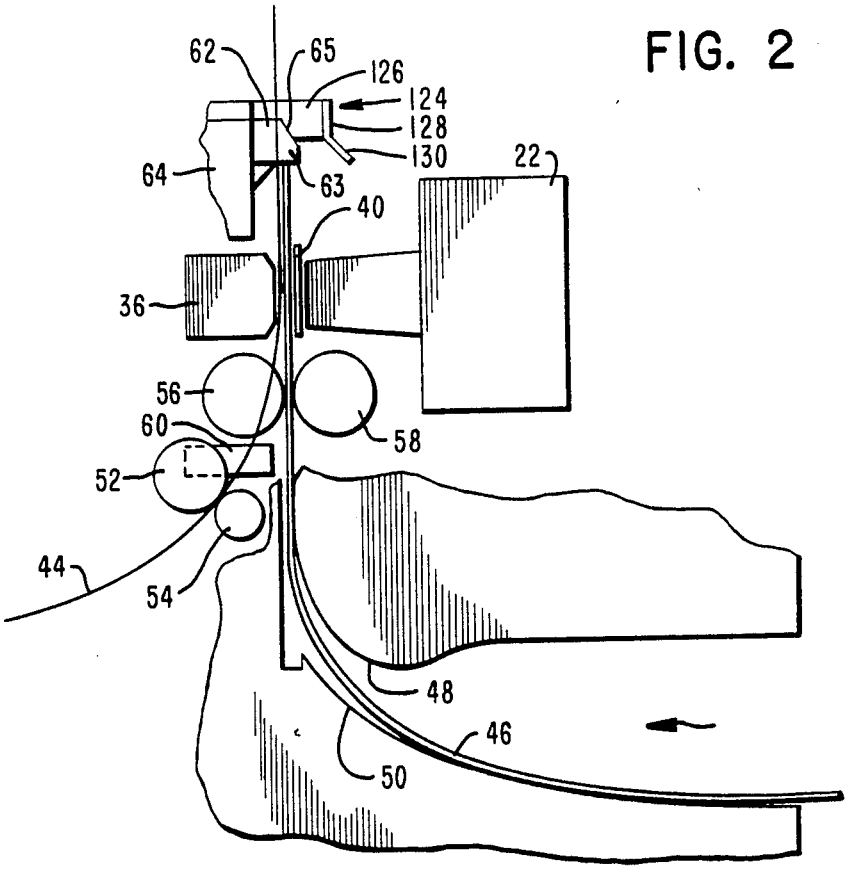
FIG. 2 is a diagrammatic view in side elevation of parts of the printer of FIG. 1.

FIG. 2 illustrates in diagrammatic manner the path of the receipt paper 44 and the path of a slip or form 46 along with guides 48 and 50 for the slip. The receipt paper 44, the slip or form 46 and the ribbon 40 are guided in a path past the printing station which includes the printhedd 22 and the platen 36.

A drive roller 52 and a pressure roller 54 are positioned to feed the receipt paper 44 from the supply roll 34 to the printing station. A drive roller 56 and a pressure roller 58 are positioned above the receipt feed rollers 52 and 54 to feed the slip or form 46 from the slot 42 at the left front of the printer 12. Such rollers 56 and 58 are also utilized to feed a slip or form past the printing station when the slip or form is inserted from the top or from the left side of the printer 12. The slip or form 46 may be of single part or multiple part construction. A minimum allowable single part form is 15 pounds weight, based on 500 sheets of 17×22 inches paper. A preferred maximum form thickness is 0.019 inches with printing in legible manner on all parts of forms having two, three or four parts.

The slip or form 46, when inserted from the front of the printer 12 through the slot 42, is advanced upwardly by the feed rolls 56 and 58, is sensed by a slip sensor 60 and engages a spring-loaded retractable slip stop 62 which is slidably mounted in a movable stop block 64. A guide rail (not shown) is provided at the right-hand side of the slot 42 for contact by the slip 46 to position the slip correctly for printing. The slip stop 62 permits initial positioning of a slip 46 for fixed first or last line printing without the requirement to visually align the slip.

A slip or form 46, when inserted from the side of the printer 12, engages the slip stop 62 which retracts rearwardly by reason of contact with the slanted or inclined surface 63 thereof. A slip or form 46, when inserted from the top of the printer 12, engages the slip stop 62 and retracts the stop 62 rearwardly by reason of contact with the slanted or inclined surface 65 thereof.

The stop block 64, as best shown in FIGS. 10 to 12 inclusive, is mounted for sliding movement by means of a slot 66 in said block which cooperates with a rail 68 fixed to a carrier 37 of the platen 36 near on end thereof. A spring 70 within the stop block 64 urges the slip stop 62 to the right as viewed in FIGS. 10, 11, but enables it to retract when engaged by a slip from the top or side, as described above.

At its rear, the stop block 64 is provided with a projection 72 on which are fixed first and second pairs of studs 74 and 76. These studs engage surfaces 78 (FIG. 3) which extend downwardly in alignment with two ears 80 in an eccentric cam member 82 which operates both the stop block 64 and the platen 36, as may best be seen in FIG. 3.

Figure 3:
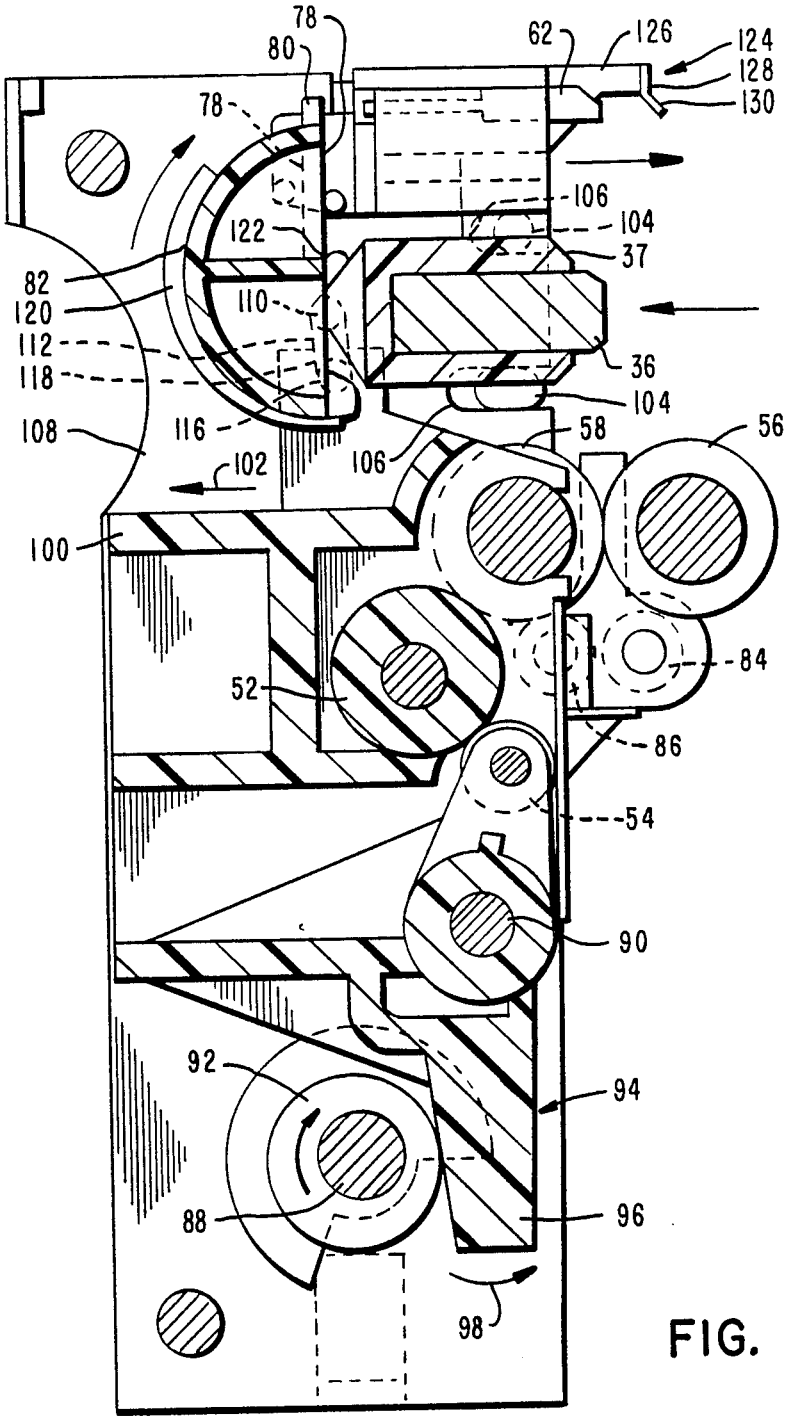
FIG. 3 is a side elevation view showing the paper guide mechanism, the slip stop, and the means for moving the slip stop.

FIG. 3 is an enlarged side sectional view of parts operatively associated with a forms compensation mechanism included in the printer which is used in the illustrated embodiment of the present invention. These parts are also used to drive the platen 36 and the stop block 64 in their desired paths of movement. The locations of the slip feed rolls 56 and 58, transfer drive gears 84 and 86, the receipt paper drive rolls 52 and 54 and the cam and pivot shafts 88 and 90 are shown for orientation purposes with respect to the remainder of the printer mechanism.

A forms compensating cam member 92, in the nature of an off-center or eccentric-like arrangement, is secured to the cam shaft 88 in a location approximately at the middle of the receipt printing station 32, the cam shaft being rotatable by a printer motor (not shown) through a gear arrangement (not shown). A forms compensating arm structure, generally designated 94, is pivoted on shaft 90 and includes portions extending generally upwardly and downwardly from the shaft 90. A downwardly extending portion 96 is engageable by the cam member 92 to be swingable on the shaft 90 to the right in FIG. 3, as indicated by the arrow 98, and an upwardly extending portion 100 is swingable about the shaft 90 to the left, as indicated by the arrow 102. The forms compensating arm structure 94 is biased in a clockwise direction by a pair of extension springs (not shown), to maintain the platen 36 in a desired forward position for printing, to force the pressure rollers 58 against the feed rollers 56, and to maintain the stop block 64 in a retracted position in which the slip stop 62 is not interposed in the path of movement of a slip.

The platen 36 is supported by means of the platen aarrier 37, which comprises a housing of generally U-shaped configuration including top, rear and bottom portions, the top and bottom portions having projecting edges 104 slidable in suitable slots 106 in the printer side plates 108 of the receipt module 32 to accomodate fore-and-aft movement of the platen 36. The platen carrier 37 includes pins as at 110, which operate in slots 112 of an eccentric cam member 82. The cam member 82 has pins 116 which operate in slots 118 in the forms compensating arm structure 94. The cam member 82 is supported by and free to rotate in bearings 120 in the side plates 108. The center of rotation of the cam member 82 is shown in FIG. 3 at 122. As previously described, the studs 74, 76 engage cooperating structure of the cam member 82, including the surfaces 78 and the ears 80, so that the cam member 82 drives the stop block 64, as well as the platen carrier 37. It is seen that rotation of the forms compensation arm structure 94 about the shaft 90 causes the cam member 82 to rotate about the center of rotation 122, which action translates the platen carrier 37 and the platen 36 in fore-and-aft direction, and also translates the stop block 64 in fore-and-aft direction, with movement of the platen 36 at any time being in an opposite direction from movement of the stop block 64. The construction of the forms compensation arm structure 94 and its relationship with the platen 36 and the stop block 64 thus provides for converting rotational motion into linear motion.

Figure 4:
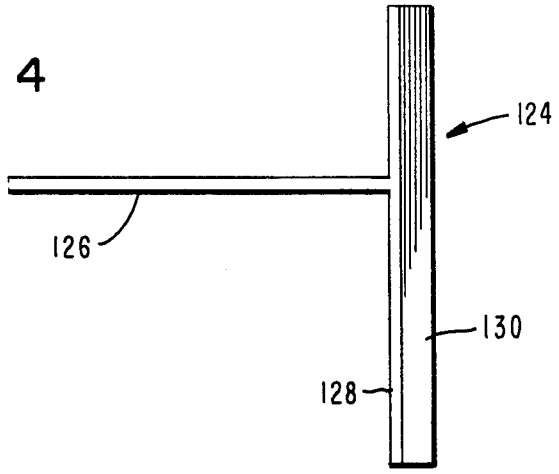
FIG. 4 is a plan view of one embodiment of the paper guide mechanism of the present invention.
Figure 5:
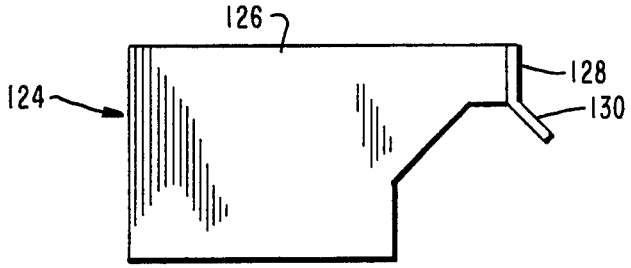
FIG. 5 is an elevation view of the paper guide mechanism embodiment of FIG. 4.
Figure 6:
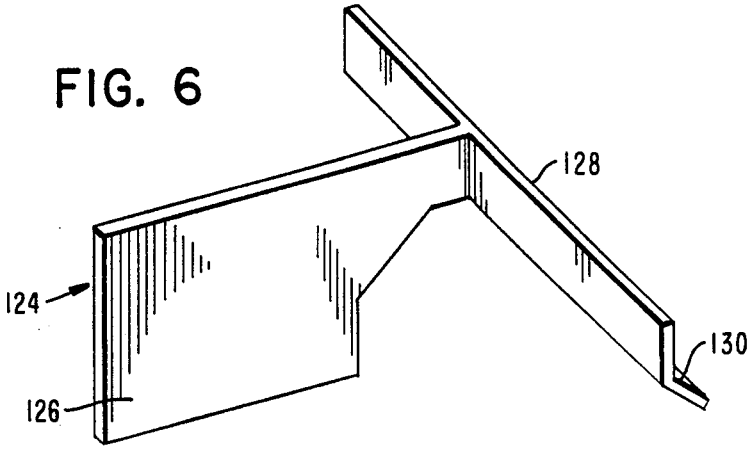
FIG. 6 is a perspective view of the paper guide mechanism embodiment of FIG. 4.

Attached to the stop block 64 by screws, rivets, adhesive or other suitable means is a paper guide member 124, shown in greater detail in FIGS. 4, 5 and 6. The member 124 includes a planar generally rectangular base 126 which may be made of meta or a suitable plastic material and which includes means such as apertures (not shown) for rivets or screns or an adhesive receiving surface. The base includes a connecting portion of less depth extending outwardly a predetermined distance from the front end of the stop block 64 to a support member 128 positioned in a vertical plane as shown in FIG. 5 hd extending to both sides of the base 126. The support member 128 may vary in length on each side in accordance with the width of the record media which it is to guide, and could extend to only one side of the base 126, if such were desirable in a particular design of printer. Extending from the lower edge of the support member 128 is a guide 130 which is coextensive in length with the support member 128, and which is disposed at a suitable angle from the vertical to enable it to engage record media such as a slip 46 when the stop block 64 is in a forward position and to bring such record media back toward the platen 36 as th stop block 64 is retracted during printer operation. When the guide member 124 is used in the printer of FIG. 1, it will be seen that the support member 128 and the guide 130 extend on one side of the base 126 to overlie the journal station or module 24, and extend on the other side of the base 126 to overlie the receipt station or module 32.

Figure 7:
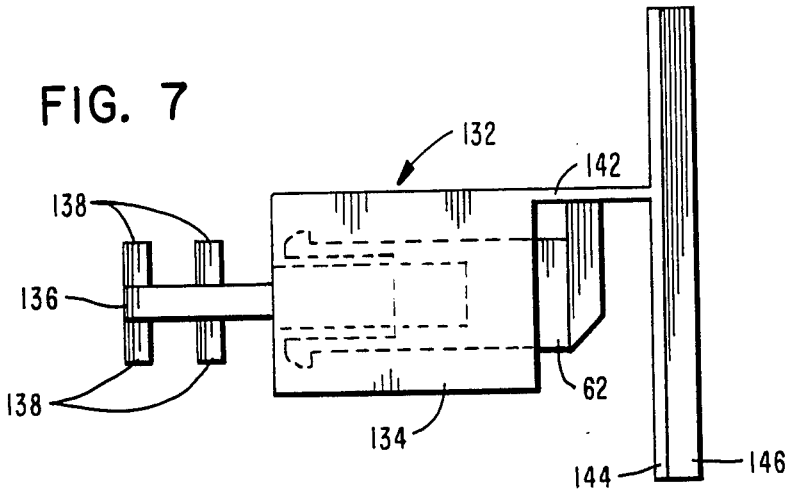
FIG. 7 is a plan view of a second embodiment of the paper guide mechanism of the present invention in which the paper guide mechanism is molded integrally with the slip stop.
Figure 8:
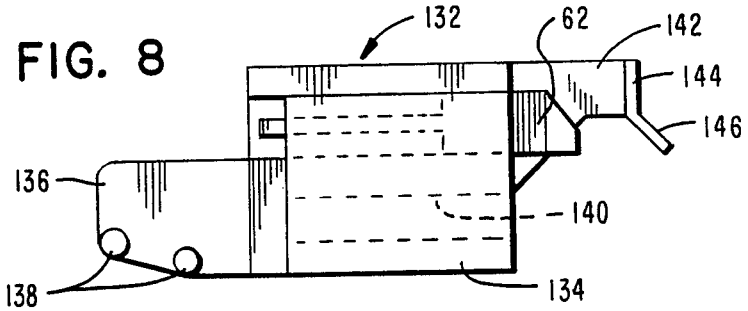
FIG. 8 is an elevation view of the combined paper guide mechanism and slip stop embodiment of FIG. 7.
Figure 9:
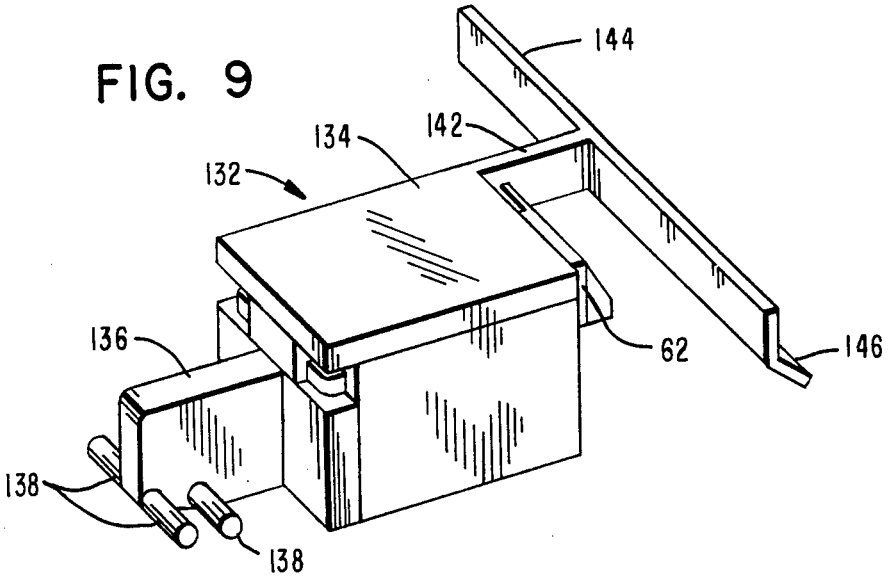
FIG. 9 is a perspective view of the combined paper guide mechanism and slip stop embodiment of FIG. 7.

Shown in FIGS. 7, 8 and 9 is an alternative embodiment of a combined stop block member and paper guide member 132 in which the block stop and the guide are molded integrally, the stop block having the general configurtion of a right parallelpiped of given length, width and depth. A stop block portion 134 is chambered to receive the slip stop 62 and includes an extension 136 provided with studs 138 for engaging the cam member 82 of the printer for causing movement of the guide member 132, as will subsequently be described. The member 132 is also provided with a lower slot 140 for riding on the rail 68 on the platen carrier 37, as has been previously described. A base portion 142 extends outwardly from the block portion 134. A support portion 144 is located at the end of the base portion 142, and a guide portion 146 extends downwardly from the support portion 144. The shapes and functions of the parts 142, 144 and 146 in FIGS. 7, 8 and 9 correspond to the shapes and functions of the extended position of the base 126 and the parts 128 and 130 in the embodiment of the guide member 124 shown in FIGS. 4, 5 and 6.

In the operation of the slip stop 62 in the associated stop block 64, with the paper guide member 124 attached to, or integral with, the block 64, it will be seen that when the slip pressure rollers 58 and the platen 36 are retracted for insertion of the slip 46, the cam member 82 has been rotated in a clockwise direction as viewed in FIG. 3 and thereby has moved the slip stop 62, the stop block 64 and the paper guide member 124 forward where the slip stop 62 is placed in the path of a slip 46 and the support member 128 and the associated guide member 124 are spaced outwardly from the slip stop 62. When a slip or form 46 is inserted from the front of the printer 12 through the slot or throat 42 below the slip stop 62, the slip 46 will contact the bottom surface of the slip stop 62 and will be stopped in a position between the stop block 64 and the guide 130 of the guide member 124, in a position which establishes a reference position for the slip or form 46 for printing the first line thereon. At this time, the portion of the support member 128 and the guide 130 on the other side of the base 126 are positioned to the outside of the journal paper in the journal station 24.

Subsequently the cam member 82 is rotated in a counterclockwise direction, thereby moving the slip stop 62, its stop block 64 and the guide member 124 to the left as viewed in FIG. 3, while the platen 36 is simultaneously moved to the right in preparation for a printing operation. Movement of the guide 130 to the left causes it to engage the journal paper and the slip 46 and move them to the left, eliminating the possibility that these record media will extend or "bow" outwardly into the path of movement of the printhead 22, to cause interference resulting in possible damage to the record media and malfunctioning of the printer 12.

While the forms of the invention shown and described herein are admirably adapted to fulfill the objects primarily stated, it is to be understood that it is not intended to confine the invention to the forms or embodiments disclosed herein, for it is susceptible of embodiment in various other forms within the scope of the appended claims.

What is claimed is:

1. Guide mechanism for a multi-function printer for guiding a journal tape and a slip to be printed upon in paths which avoid interference with a printhead which moves in reciprocating motion in a direction perpendicular to the paths of movement of said journal tape and said slip to print on both the journal tape and the slip, comprising:

first and second adjacent printing stations for printing on said slip and said journal tape respectively;

a moveable printhead operable to traverse both of said printing stations in reciprocating movement;

a platen in said first printing station arranged to cooperate with said printhead for printing on a slip positioned between said platen and said printhead, said platen being movable between a retracted position which enables placement of a slip between said printhead and said platen, and a forward position for a printing operation;

a stop member in said first printing station and adjacent to said second printing station, movable between an extened position in which it is operable to limit movement of a slip introduced for printing and a retracted position;

means to move both the platen and the stop member so that when said platen is in said forward position, said stop member is in said retracted position, and vice versa; and a paper guide member fixed to said stop member and extending outwardly therefrom and movable with said stop member, said guide member including a projecting portion extending outwardly from the stop member; a support member at the end of said projecting portion and perpendicular thereto, spaced from said stop member and parallel to the path of movement of said printhead, extending in both directions from said projecting portion to overhand both printing stations; and a guide extending downwardly from said support member and adapted to extend over the slip and the journal tape when the stop member is in its extended position and to carry the slip and the journal tape backward as the stop member is moved toward its retracted position, thus eliminating possible interference by the slip and the journal tape with movement of the printhead.

2. The guide mechanism of claim 1, in which the guide of the paper guide member extends downwardly from the support member at an angle inclined outwardly away from the stop member.

3. The guide mechanism of claim 1, in which the paper guide member is metal.

4. The guide mechanism of claim 1 in which the paper guide member is integral with the stop member.

5. Guide mechanism for guiding paper to be printed upon in a path which avoids interference with a printhead which movs in reciprocating motion in a direction perpendicular to the path of movement of said paper, comprising:

a movable printhead;

a platen arranged to cooperate with said printhead for printing on paper positioned between said platen and said printhead, said platen being movable between a retracted position which enables placement of paper between said printhead and said platen, and a forward position for a printing operation;

a stop member movable between an extended position in which it is operable to limit movement of paper introduced for printing and a retracted position;

means to move both the platen and the stop member so that when said platen is in said forward position, said stop member is in said retracted position, and vice versa; and a paper guide fixed to said stop member and extending outwardly therefrom and movable with said stop member, said guide member including a projejcting portion extending outwardly from the stop member, a support member at the end of said projecting portin and perpendicular thereto, spaced from said stop member and parallel to the path of movement of said printhead; and a guide extending downwardly from said support member and adapted to extend over a length of paper when the stop member is in its extended position and to carry the paper backward as the stop member is moved toward its retracted position, thus eliminating possible interference by the paper with movement of the printhead.

6. The guide mechanism of claim 5, in which the guide of the paper guide memer extends downwardly from the support member at an angle inclined outwardly away from the stop member.

7. The guide mechanism of claim 5, in which the paper guide member is metal.

8. The guide mechanism of claim 5, in which the paper guide member is integral with the stop member.

9. A paper guide member for use in a printer, comprising:

a planar portion adapted for attachment to a stop member of a printer, and being of generally rectangular configuration having a given length and depth;

a connecting portion integral with one end of said planar portion and projecting outwardly therefrom, having an upper surface aligned with an upper surface of said planar portion and being of lesser depth than said planar portion;

an elongated planar support member positioned at the end of said connecting portion, having an upper surface in the same plane as the upper surface of the connecting portion, and extending perpendicularly from said connecting portion is two opposite directions; and a planar guide member for guiding the movement of paper to be printed upon attached to and extending downwardly from said support member all along its length, at an angle inclin®d away from said projecting portion.

10. A combined paper stop and guide member for use in a printer, comprising:

a stop member having the general configuration of a right parallelepipe of given length, width and depth;

a connecting portion integral with the end of said stop member projecting outwardly therefrom, having an upper surface aligned with an upper face of said stop member, and being of lesser length, width and depth than said stop member;

an elongated planar supoprt member positioned at the end of said connecting poriton, having an upper surface in the same plane as the upper surface of the connecting portion, and extending perpendicularly from said conencting portion in two opposite directions; and a planar guide meber for guiding the movement of paper to be printed upon, attached to and extending downwardly from said support member all along its length, at an angle inclined away from said projecting portion.

11. The combined paper stop and guide member of claim 10 in which said stop member includes an aperture therien in which is mounted a movable stop element which normally protrudes from a first end face of said stop member.

12. The combined paper stop and guide member of claim 11 in which said stop member includes engaging means attached to a second end face opposite from said first end face to engage with driving mechanism of said printer to enable said combined paper stop and guide member to be moved during printer operation.

* * * * *

UNITED STATES PATENT AND TRADEMARK OFFICE

CERTIFICATE OF CORRECTION

PATENT NO. : 4,795,282

DATED : January 3, 1989

INVENTOR(S) : William R. Bradam

It is certified that error appears in the above-identified patent and that said Letters Patent is hereby corrected as shown below:

Column 6, line 66, delete "extened" and substitute --extended--.

Column 7, line 33, delete "movs" and substitute --moves--.

Column 7, line 55, delete "jejcting" and substitute --jecting--.

Column 7, line 57, delete "portin" and substitute --portion--.

Column 8, line 4, delete "memer" and substitute --member--.

Column 8, line 26, delete "is" and substitute --in--.

Column 8, line 31, delete "inclinsd" and substitute --inclined--.

Column 8, line 36, delete "parallelepipe" and substitute --parallelepiped--.

Column 8, line 43, delete "supoprt" and substitute --support--.

Column 8, line 44, delete "poriton" and substitute --portion--.

UNITED STATES PATENT AND TRADEMARK OFFICE

CERTIFICATE OF CORRECTION

PATENT NO. : 4,795,282

DATED : January 3, 1989

INVENTOR(S) : William R. Bradam

It is certified that error appears in the above-identified patent and that said Letters Patent is hereby corrected as shown below:

Column 8, line 47, delete "conencting" and substitute --connecting--.

Column 8, line 49, delete "meber" and substitute --member--.

Column 8, line 56, delete "therien" and substitute --therein--.

Signed and Sealed this

Thirtieth Day of May, 1989

*Attest:*

DONALD J. QUIGG

*Attesting Officer*

*Commissioner of Patents and Trademarks*